US009713212B2

(12) United States Patent
Hui et al.

(10) Patent No.: US 9,713,212 B2
(45) Date of Patent: Jul. 18, 2017

(54) CURRENT MIRROR CIRCUIT AND METHOD

(71) Applicant: VERSITECH LIMITED, Hong Kong (CN)

(72) Inventors: Ron Shu Yuen Hui, Hong Kong (CN); Sinan Li, Heilongjiang (CN)

( * ) Notice: Subject to any disclaimer, the term of this patent is extended or adjusted under 35 U.S.C. 154(b) by 20 days.

(21) Appl. No.: 14/443,906

(22) PCT Filed: Nov. 21, 2012

(86) PCT No.: PCT/CN2012/084965

§ 371 (c)(1),
(2) Date: May 19, 2015

(87) PCT Pub. No.: WO2014/078998

PCT Pub. Date: May 30, 2014

(65) Prior Publication Data

US 2015/0327338 A1 Nov. 12, 2015

(51) Int. Cl.

| | |
|---|---|
| ***G05F 3/16*** | (2006.01) |
| ***G05F 3/26*** | (2006.01) |
| ***H05B 33/08*** | (2006.01) |

(52) U.S. Cl.

CPC ..... *H05B 33/083* (2013.01); *G05F 3/16* (2013.01); *H05B 33/089* (2013.01); *H05B 33/0827* (2013.01); *G05F 3/26* (2013.01)

(58) Field of Classification Search

CPC ..... G05F 3/16; G05F 3/20; G05F 3/22; G05F 3/222; G05F 3/24; G05F 3/242

(Continued)

(56) References Cited

U.S. PATENT DOCUMENTS

2008/0164828 A1* 7/2008 Szczeszynski ..... G05F 1/46 315/300
2010/0109537 A1* 5/2010 Nishino ..... H05B 33/0827 315/185 R (Continued)

FOREIGN PATENT DOCUMENTS

CN 101529983 A 9/2009
CN 201752155 U 2/2011

(Continued)

OTHER PUBLICATIONS

The State Intellectual Property Office, The P.R. China (SIPO), International Search Report for international patent application PCT/CN2012/084965, Aug. 29, 2013, pp. 1-2, SIPO.

(Continued)

*Primary Examiner* — Timothy J Dole
*Assistant Examiner* — David A. Singh

(57) ABSTRACT

Provided is a current mirror circuit (1) for balancing respective currents in a plurality of parallel circuit branches (2) in a target circuit (3), the current mirror circuit (1) including: a plurality of balancing transistors (4), each having a connector (5), an emitter (6), and a base (7), the collector (5) and emitter (6) of each balancing transistor (4) connected in series with a respective circuit branch (2); a selection circuit (8) that connects the circuit branch (2) having the smallest current amongst the circuit branches (2) to the bases (7) of each balancing transistor; and an isolation circuit (9) that isolates circuit branches (2) having an open circuit fault from the rest of the target circuit (3). An associated method of balancing respective currents in a plurality of parallel circuit branches (2) in a target circuit (3) is also provided.

11 Claims, 21 Drawing Sheets

(58) Field of Classification Search
USPC ..... 323/312–317
See application file for complete search history.

(56) References Cited

U.S. PATENT DOCUMENTS

2010/0122118 A1* 5/2010 Otani ..... G06F 11/3034 714/42
2010/0283396 A1* 11/2010 Chen ..... H05B 33/0812 315/185 R
2011/0031898 A1* 2/2011 Lin ..... H05B 33/0827 315/297
2011/0062872 A1* 3/2011 Jin ..... H05B 33/0818 315/122
2012/0074845 A1* 3/2012 Aoki ..... H05B 33/0845 315/119
2012/0074856 A1* 3/2012 Takata ..... H05B 33/0815 315/192
2012/0081016 A1 4/2012 Wu et al.
2012/0286753 A1* 11/2012 Zhong ..... H05B 33/0827 323/282
2013/0140990 A1* 6/2013 Campos ..... H05B 33/0893 315/120
2014/0085005 A1* 3/2014 Gerstenhaber ..... H03F 1/3211 330/288

FOREIGN PATENT DOCUMENTS

CN 102098826 A 6/2011
EP 2094063 A 8/2009
JP 2008243641 A 10/2008
TW 201236298 A 9/2012
WO 2012095680 A 7/2012

OTHER PUBLICATIONS

European Patent Office (EPO), EP12888762 supplementary European search report, Jul. 1, 2016, 2 pages, Munich, Germany, EPO.
Taiwan Intellectual Property Office (TIPO), TW102142014 Taiwan search report, Mar. 8, 2017, 1 page, Taiwan, TIPO.

* cited by examiner

PRIOR ART

PRIOR ART

PRIOR ART

PRIOR ART

PRIOR ART

CURRENT MIRROR CIRCUIT AND METHOD

TECHNICAL FIELD

The present invention relates to current mirror circuits and methods. The present invention is described herein primarily in relation to, but not limited to, use with parallel light-emitting diode (LED) strings.

BACKGROUND ART

Current mirror circuits have recently been considered for use in reducing current imbalance in parallel LED strings. The lifetime of LED devices is sensitive to operating currents. If LED devices are arranged in parallel strings, for example, as a means to increase power and light output, the slight differences among LED devices would cause current imbalance among LED strings, therefore affecting the light uniformity and lifetime of the overall LED system. There are many current balancing techniques. However, the new concept of self-configurable and re-configurable current mirror circuits that do not require using a predetermined current reference and a separate power supply to provide a current reference was disclosed in PCT publication WO 2012/095680. A typical embodiment of such circuits is shown in FIG. 1.

For current mirror circuits, it is necessary to choose a current reference for other current sources to follow. Where current mirror circuits are used for parallel LED strings, the current source with the smallest current should be chosen as the current reference. In the circuit shown in FIG. 1, selection switches in the form of S-transistors are included in the current mirror circuit, which also includes Q-transistors in respective parallel current sources. FIG. 2 shows a version of the current mirror circuit in FIG. 1 in more detail. The circuit in FIG. 2, which has been practically confirmed, includes an auxiliary circuit to select the current source with the smallest current as the current reference, and thus select which S-transistor to close. An improved version of this self-reconfigurable current mirror circuit incorporates an opamp assisted circuit, as shown in FIG. 3. The power supply for the opamp circuit can be derived from a simple circuit, as shown in FIG. 4 for a 2-string system.

However, while the circuits in FIG. 2 and FIG. 3 work well under normal situations, the circuits will fail to operate when one of the strings suffers an open circuit fault. It should be noted that a short circuit fault of one device within a LED string only increases current imbalance, and will not cause the current mirror circuit to fail.

FIG. 5 highlights the open circuit problem when the last string of the circuit of FIG. 3 suffers an open circuit fault, which is marked as a cross "x" in FIG. 5. Under this open circuit fault, the electric potential $V_{in3}$ at point A of the circuit is not floating, since the transistor $S_3$ is still conducting. The voltage at point A will fall to a very low value because the base-collector of the bipolar junction transistor (BJT) $Q_3$ conducts through the diode action of the base-collector of $S_3$. The low current though this base-collector of $S_3$ is small and so is the voltage drop across the resistor $R_E$ of the faulty current string.

Consequently, the voltage at point A will be very low. It will be equal to the sum of the voltage of the collector-emitter voltage of transistor $Q_3$ and the voltage across $R_E$ of the faulty string. Since $R_E$ is a resistor with a low resistance value (typically a few ohms) and the current coming from the base-collector diode of $S_3$ is small, the voltage across $R_E$ of the faulty string is also very small. Such a low voltage at point A will mislead the current mirror detection circuit to wrongly select this faulty string as the current reference. FIG. 6 shows the practical measurements of the three currents of the circuit in FIG. 5, with each of the three LED current strings suddenly cut off to simulate an open circuit fault. It can be seen that the three currents drop to near zero.

DISCLOSURE OF INVENTION

Technical Problem

It is an object of the present invention to overcome or ameliorate at least one of the disadvantages of the prior art, or to provide a useful alternative.

SOLUTION TO PROBLEM

Technical Solution

The present invention provides, in a first aspect, a current mirror circuit for balancing respective currents in a plurality of parallel circuit branches in a target circuit, the current mirror circuit including:

a plurality of balancing transistors, each having a collector, an emitter, and a base, the collector and emitter of each balancing transistor connected in series with a respective circuit branch;

a selection circuit that connects the circuit branch having the smallest current amongst the circuit branches to the bases of each balancing transistor; and an isolation circuit that isolates circuit branches having an open circuit fault from the rest of the target circuit.

Preferably, the isolation circuit disconnects the circuit branch having the smallest current amongst the circuit branches from the base of the balancing transistors of circuit branches having an open circuit fault, thereby isolating circuit branches having an open circuit fault from the rest of the target circuit.

Preferably, the isolation circuit includes a fault detection logic circuit to detect whether there is an open circuit fault in one or more of the circuit branches, thereby allowing the isolation circuit to isolate those said one or more circuit branches having an open circuit fault from the rest of the target circuit.

Also preferably, the isolation circuit includes a plurality of fault detection logic circuits, each corresponding to a respective circuit branch to detect whether there is an open circuit fault in said respective circuit branch, thereby allowing the isolation circuit to isolate said respective circuit branch from the rest of the target circuit where said respective circuit branch has an open circuit fault.

Preferably, the isolation circuit includes a plurality of isolation switches, each corresponding to a respective circuit branch and openable to disconnect the circuit branch having the smallest current amongst the circuit branches from the base of the balancing transistor of said respective circuit branch.

Preferably, the selection circuit includes a plurality of switching transistors, each switching transistor having a collector, an emitter, and a base, the collector of each switching transistor connected to a respective circuit branch, the emitter of each switching transistor connected to the base of the balancing transistor of said respective circuit branch, and the base of each switching transistor connected to the isolation switch corresponding to said respective circuit branch.

Preferably, the current mirror circuit includes at least one opamp connected between two of the circuit branches for feedback assistance, the opamp having an inverting input connected to one of said two circuit branches, a non-inverting input connected to the other of said two circuit branches, and an output connected to the base of the balancing transistor of one of said two circuit branches, the isolation circuit including at least one feedback isolation switch to isolate the circuit branch connected to the non-inverting input from the rest of the target circuit where the circuit branch connected to the non-inverting input has an open circuit fault.

Preferably, the isolation circuit includes an isolation resistor connected to the non-inverting input such that the non-inverting input is not floating when the at least one feedback isolation switch is opened.

The present invention also provides, in a second aspect, a method of balancing respective currents in a plurality of parallel circuit branches in a target circuit, the method including:

providing a plurality of balancing transistors, each having a collector, an emitter, and a base, the collector and emitter of each balancing transistor connected in series with a respective circuit branch;

connecting the circuit branch having the smallest current amongst the circuit branches to the bases of each balancing transistor; and isolating circuit branches having an open circuit fault from the rest of the target circuit.

Preferably, the method includes disconnecting the circuit branch having the smallest current amongst the circuit branches from the base of the balancing transistors of circuit branches having an open circuit fault, thereby isolating circuit branches having an open circuit fault from the rest of the target circuit.

Preferably, the method includes providing at least one opamp connected between two of the circuit branches for feedback assistance, the opamp having an inverting input connected to one of said two circuit branches, a non-inverting input connected to the other of said two circuit branches, and an output connected to the base of the balancing transistor of one of said two circuit branches, the method including isolating the circuit branch connected to the non-inverting input from the rest of the target circuit where the circuit branch connected to the non-inverting input has an open circuit fault.

BRIEF DESCRIPTION OF DRAWINGS

Description of Drawings

Figure 1:
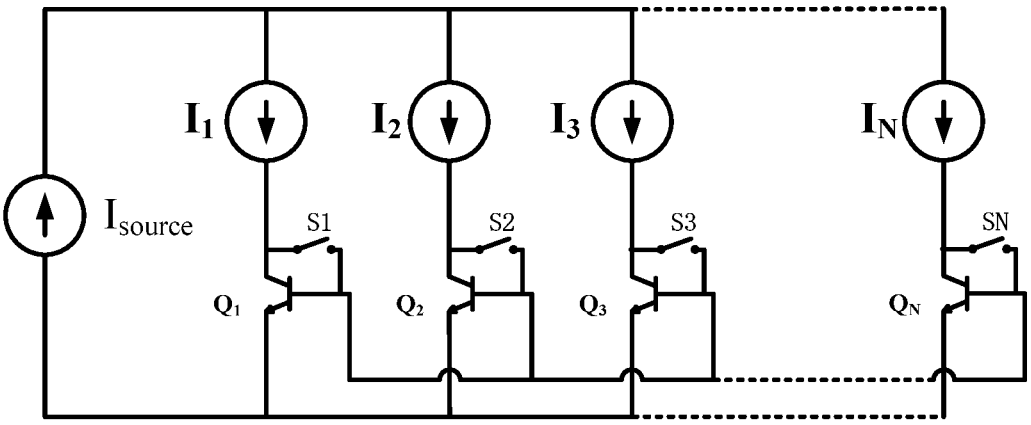
Figure 2:
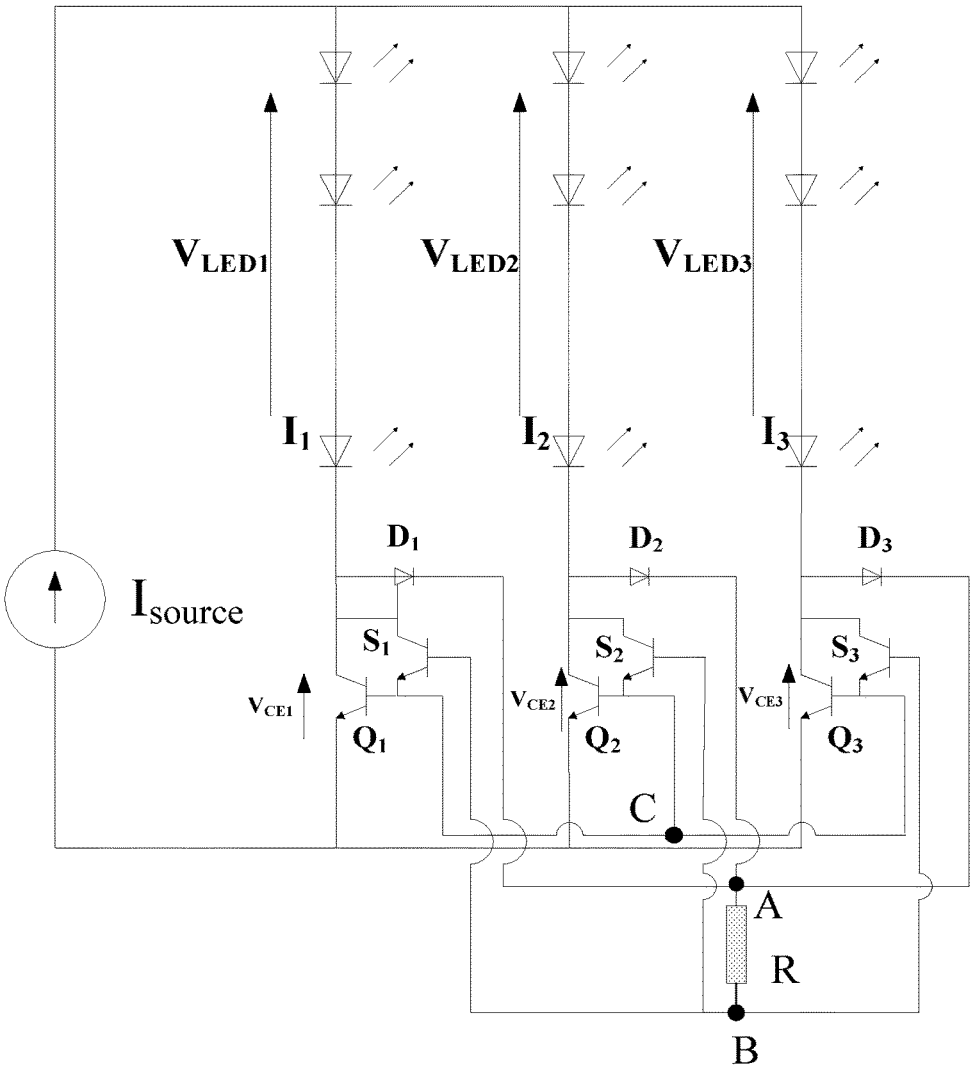
Figure 3:
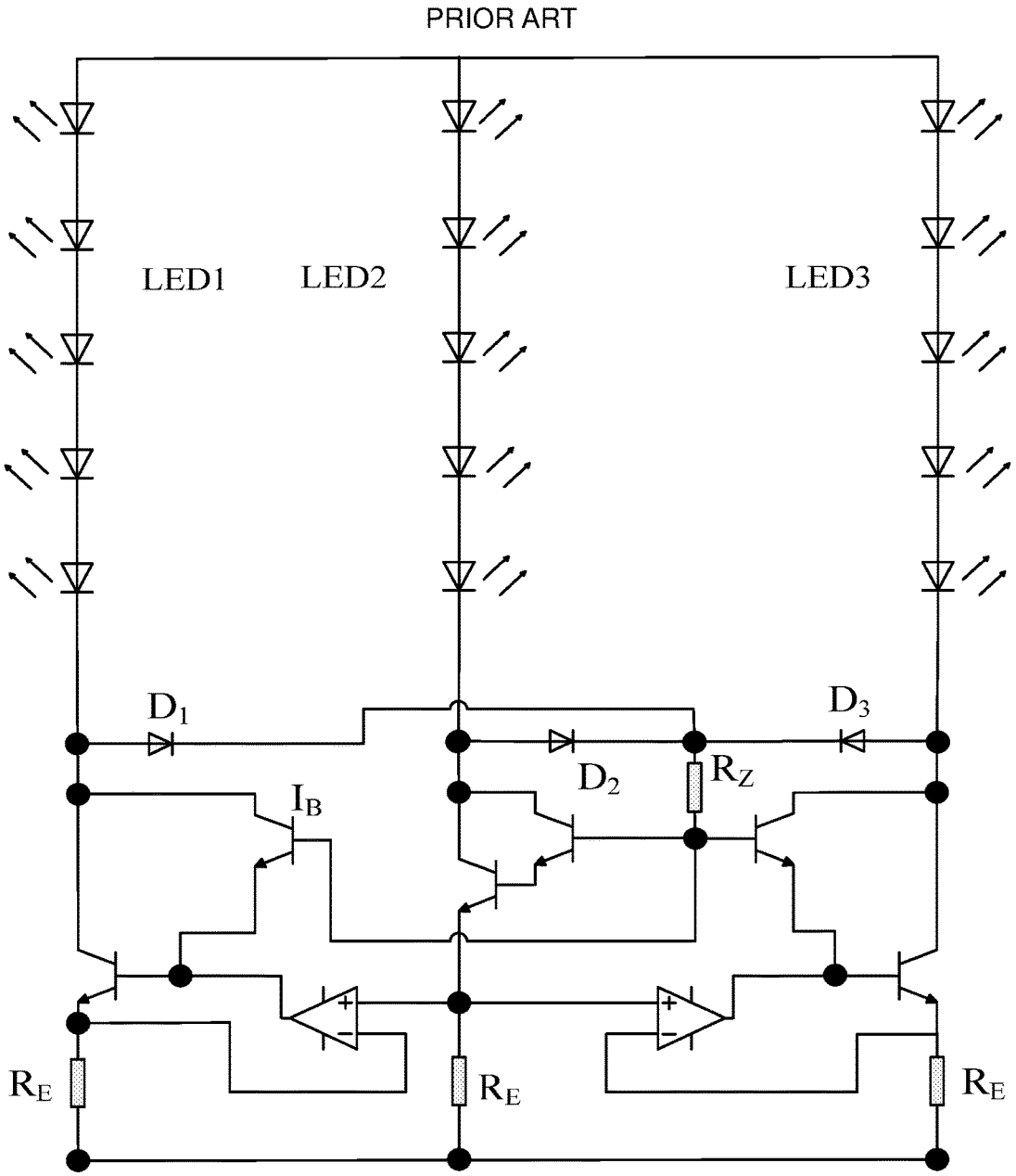
Figure 4:
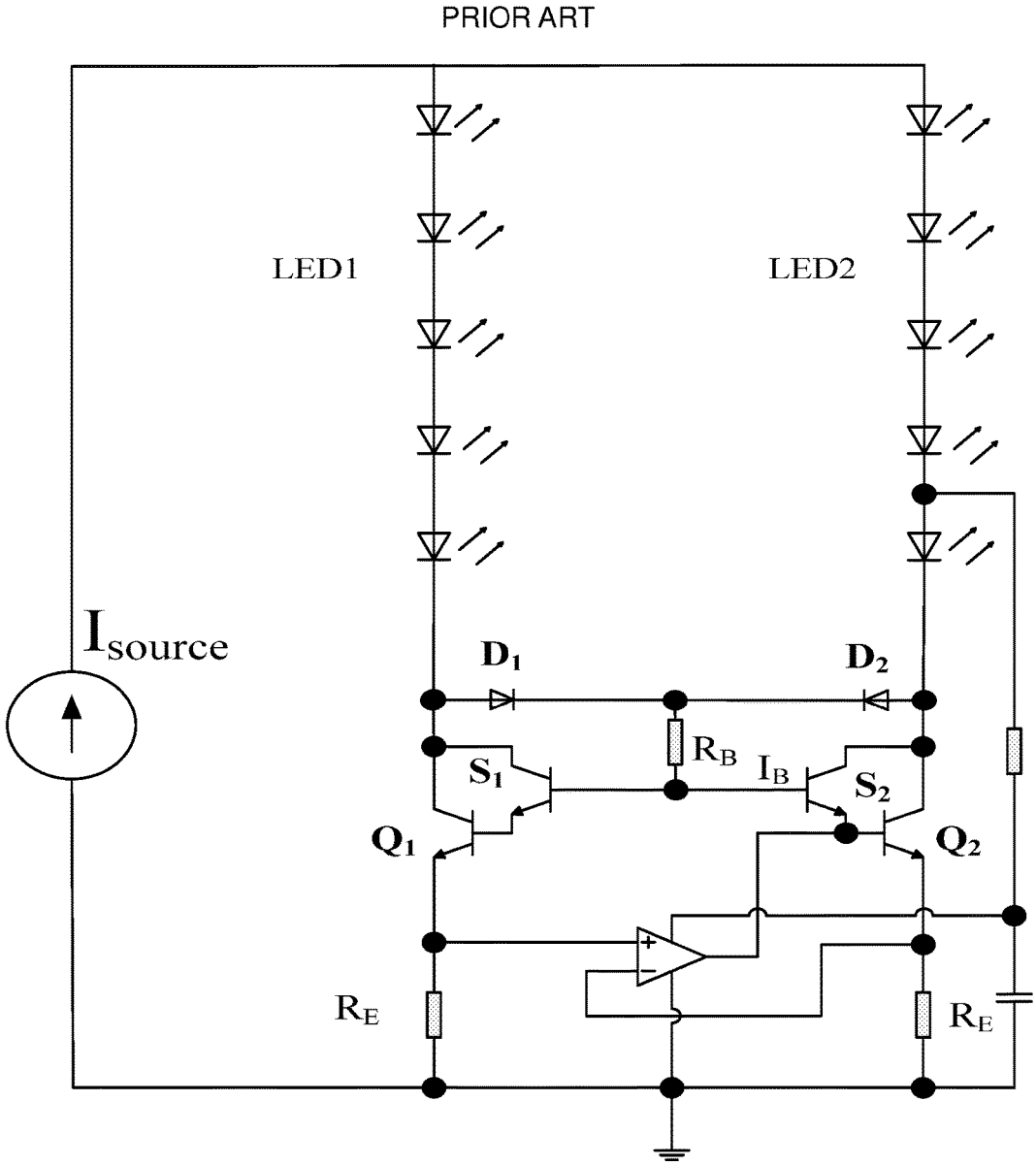
Figure 5A:
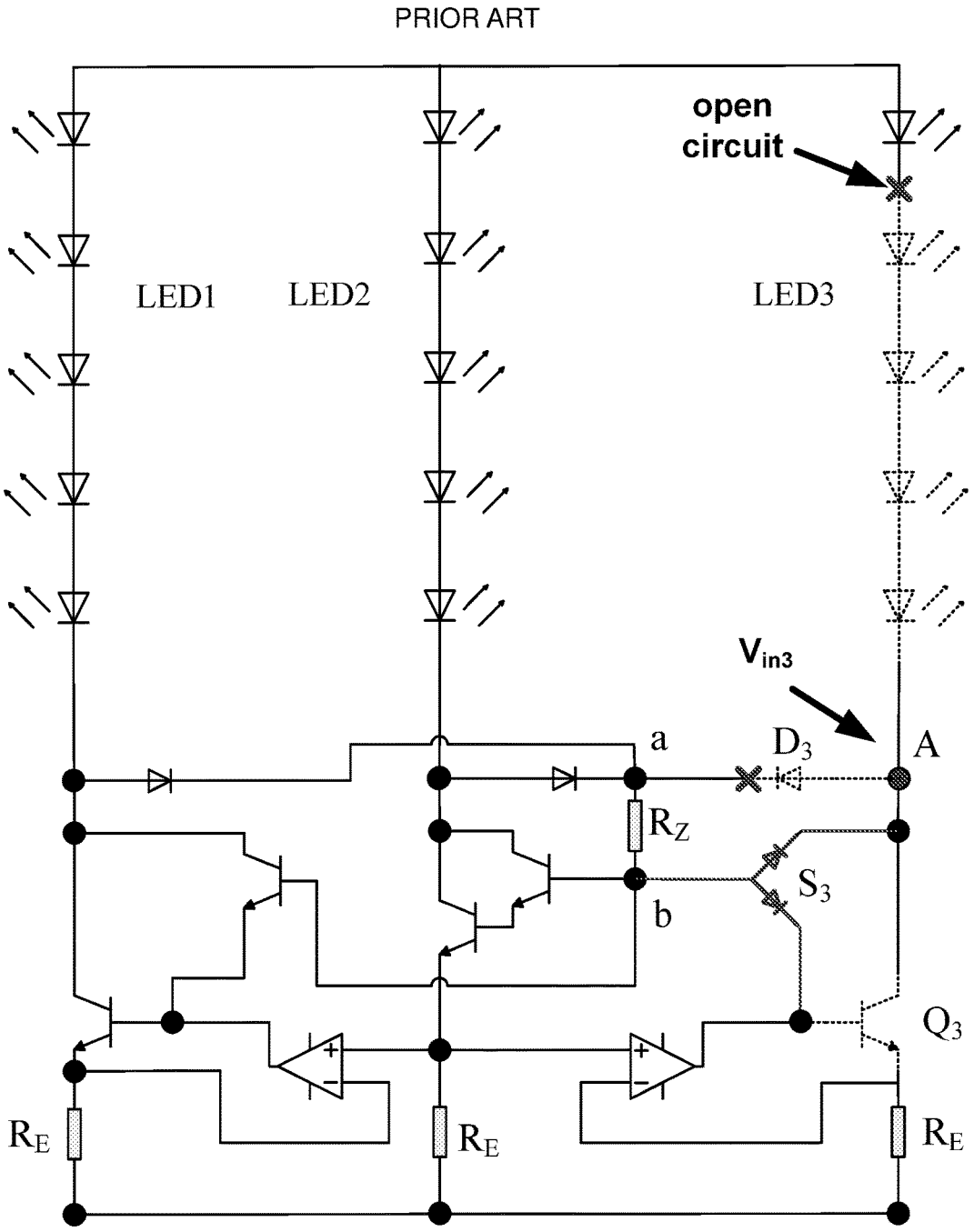
Figure 5B:
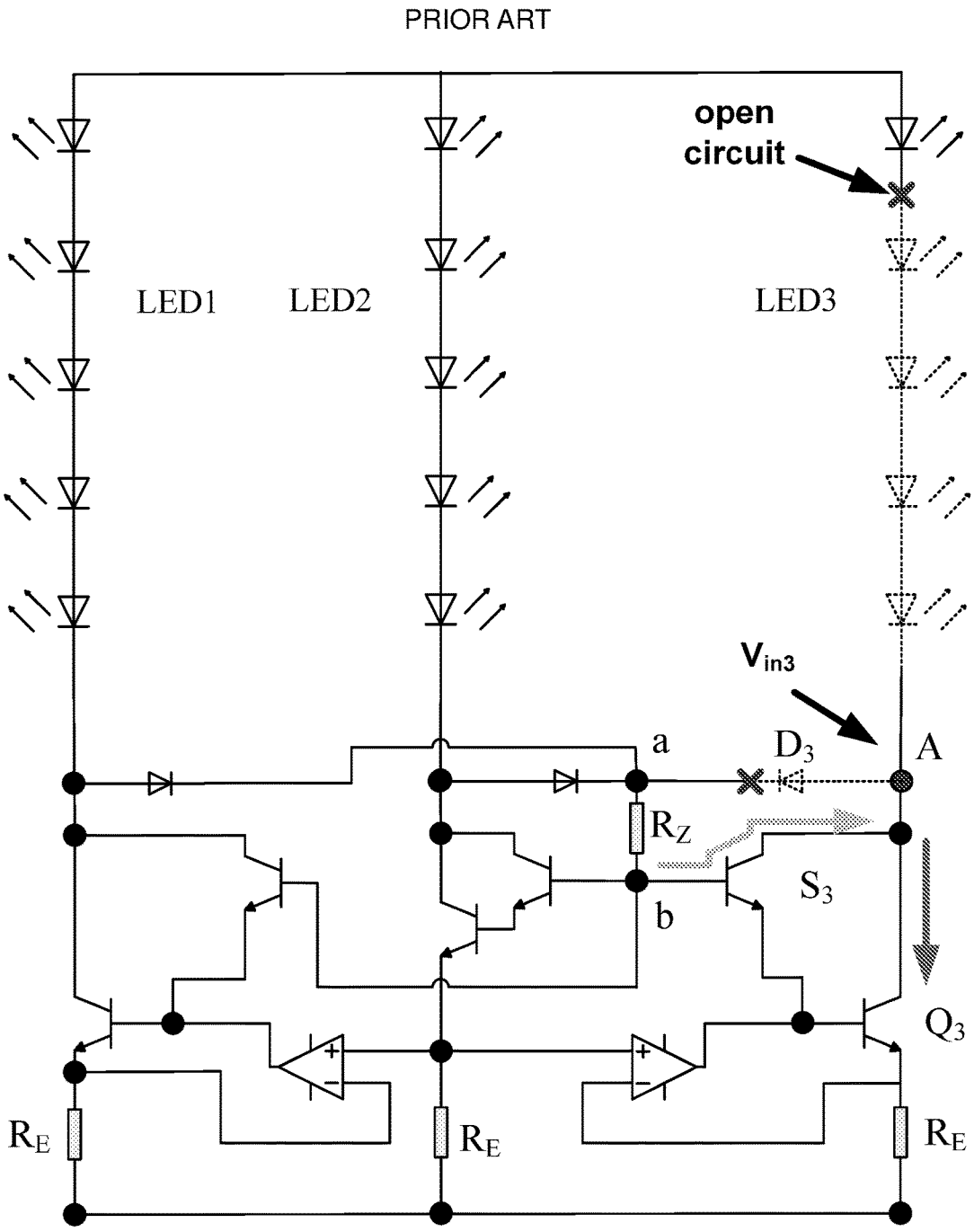
Figure 6A:
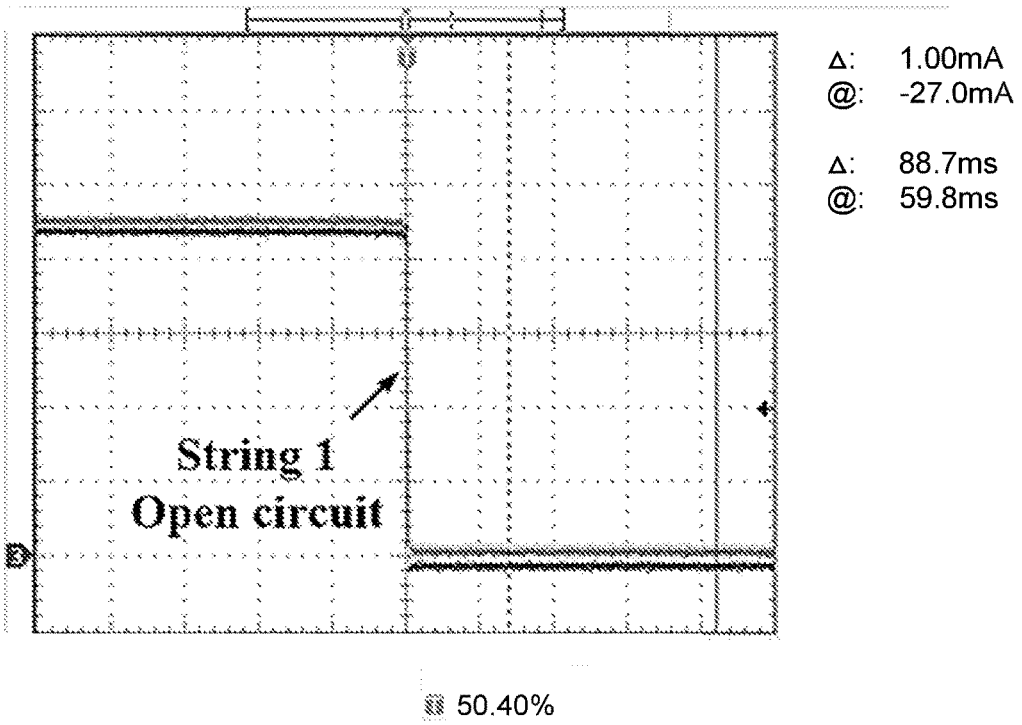
Figure 6B:
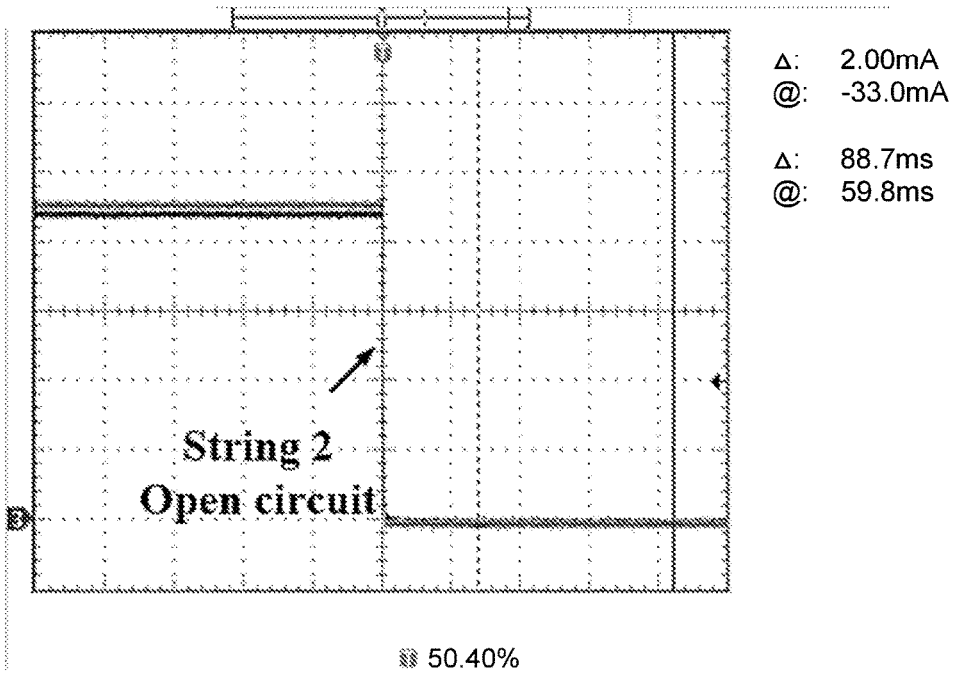
Figure 6C:
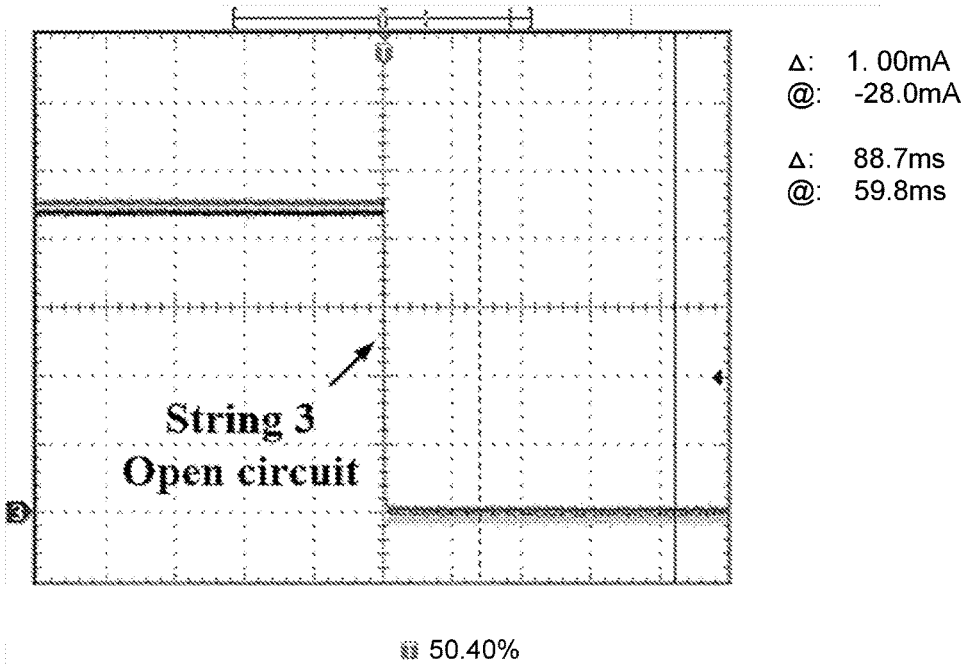
Figure 7:
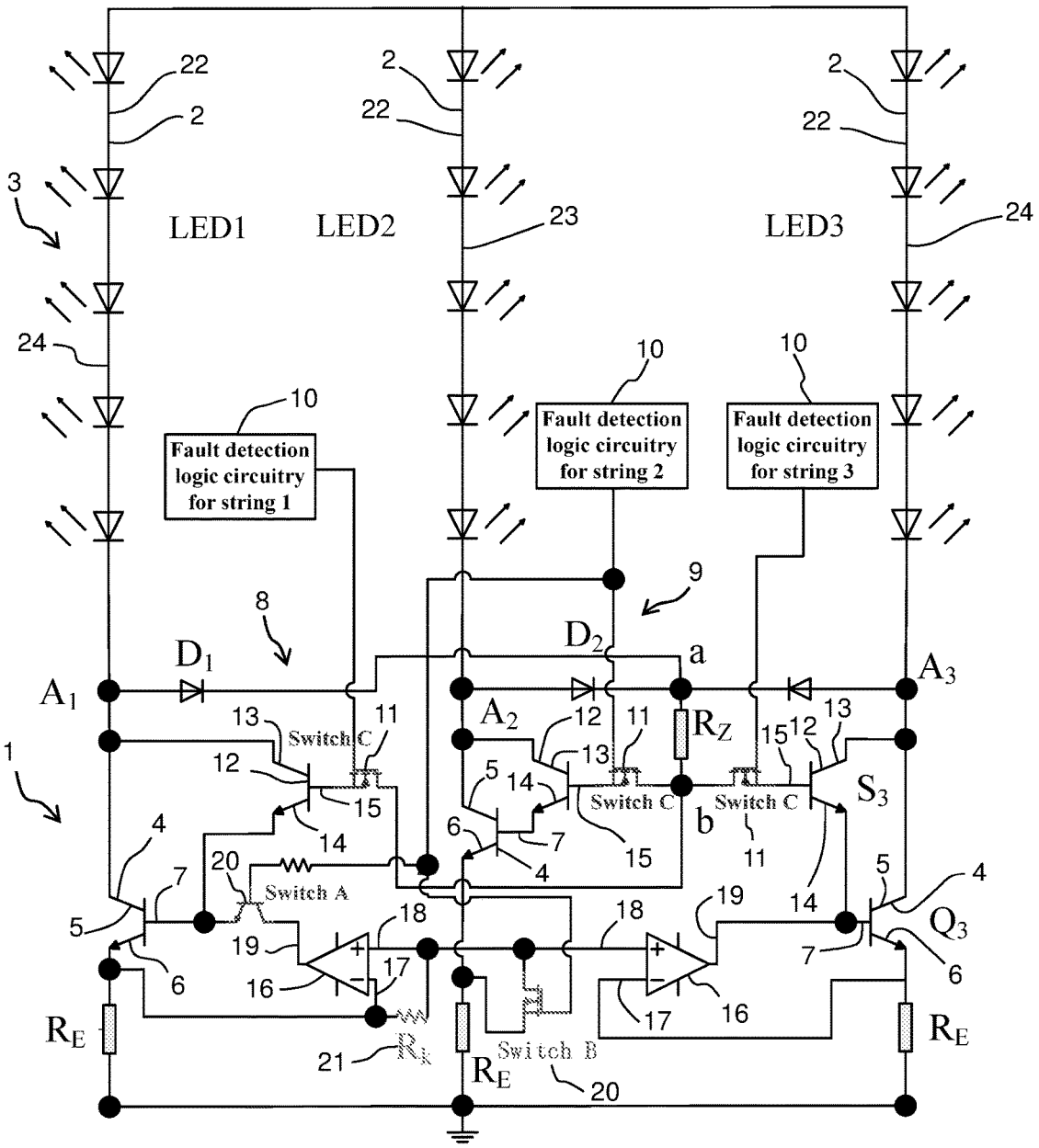
Figure 8A:
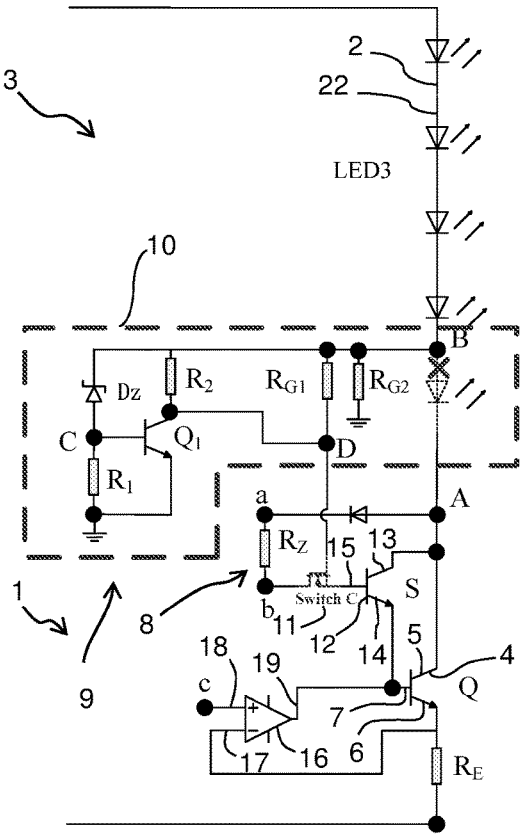
Figure 8B:
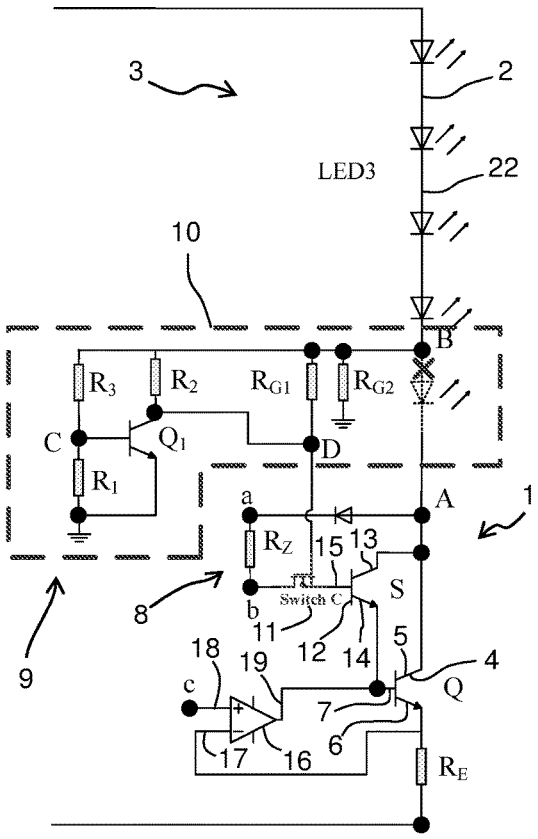
Figure 9:
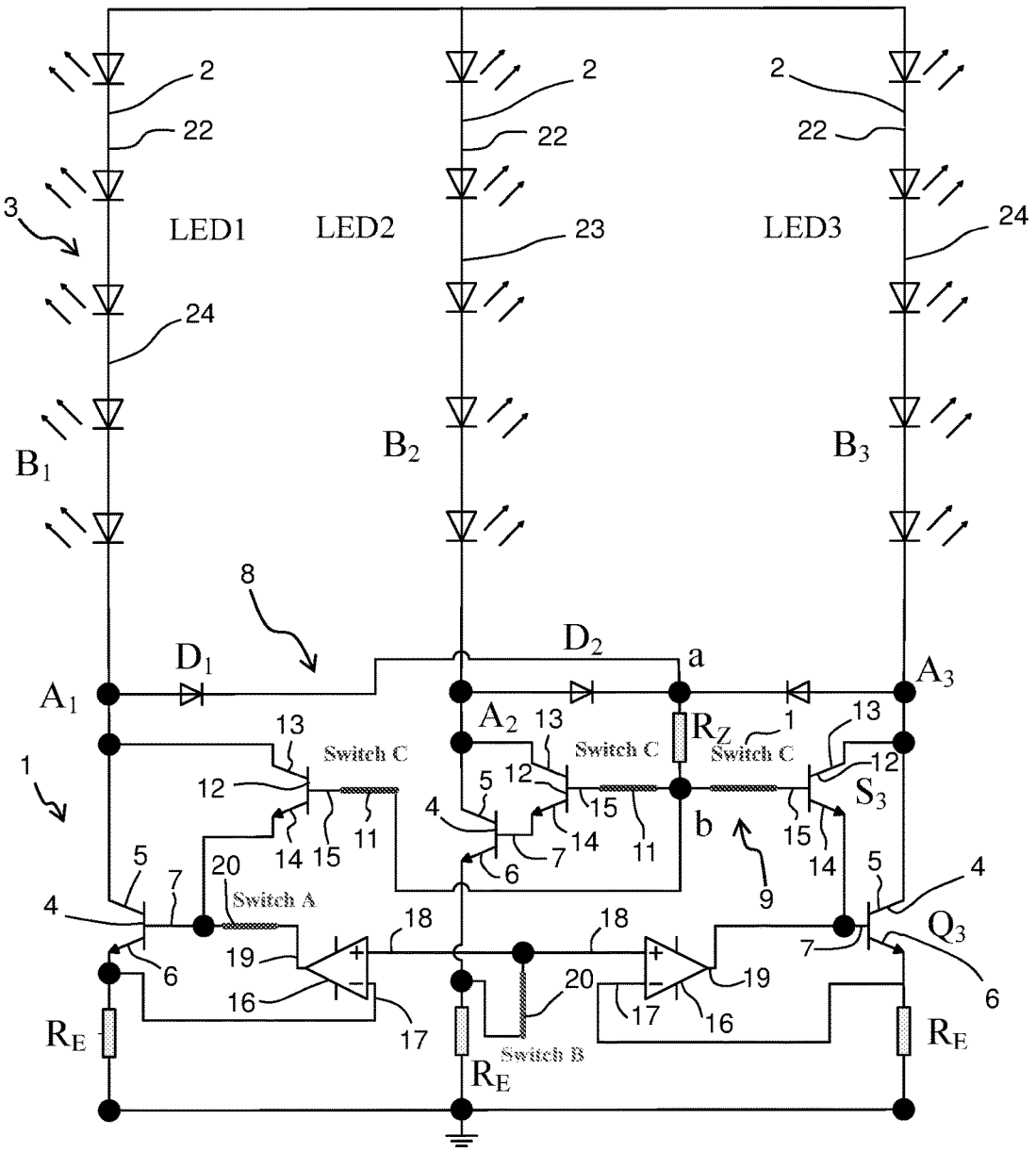
Figure 10A:
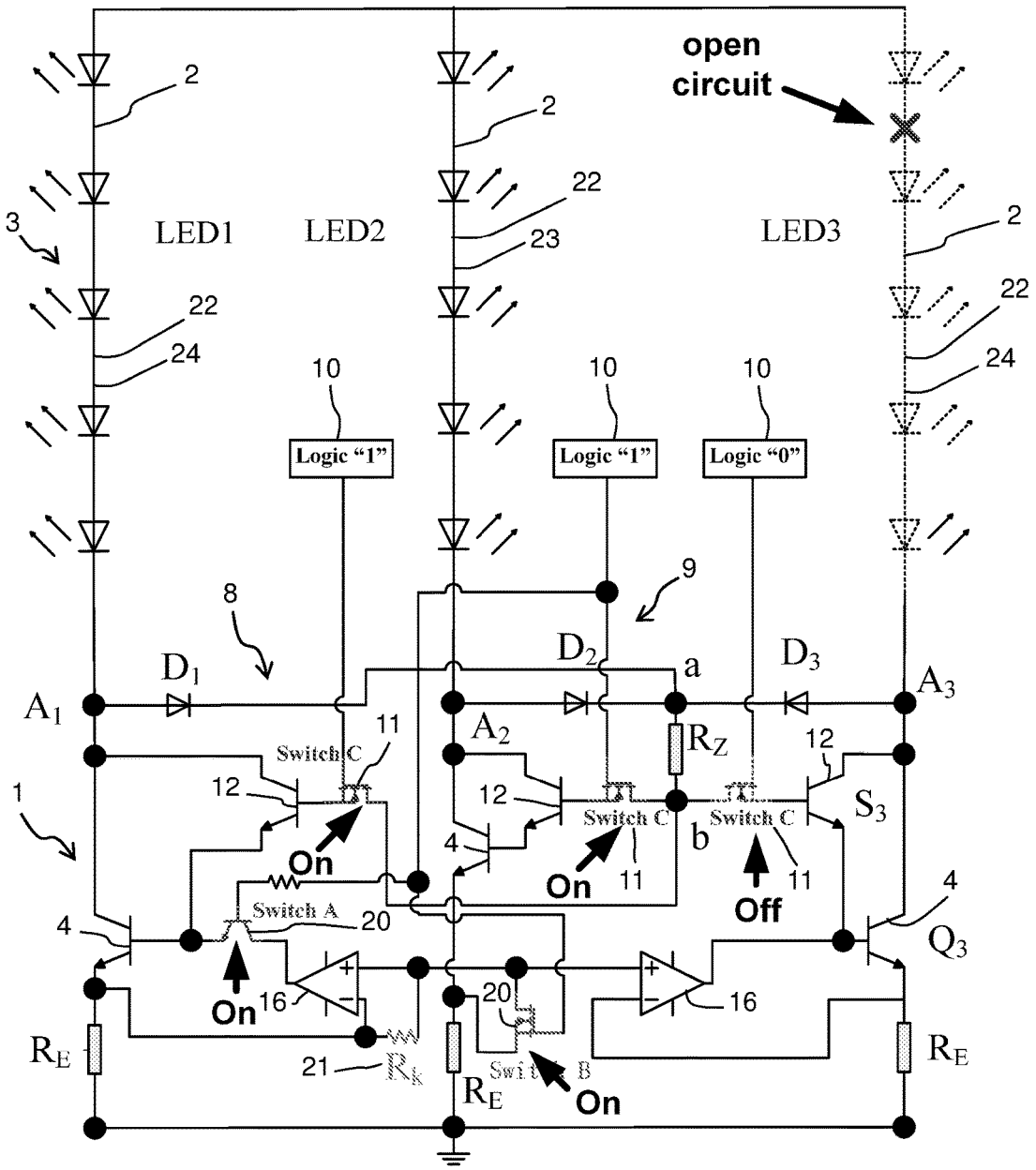
Figure 10B:
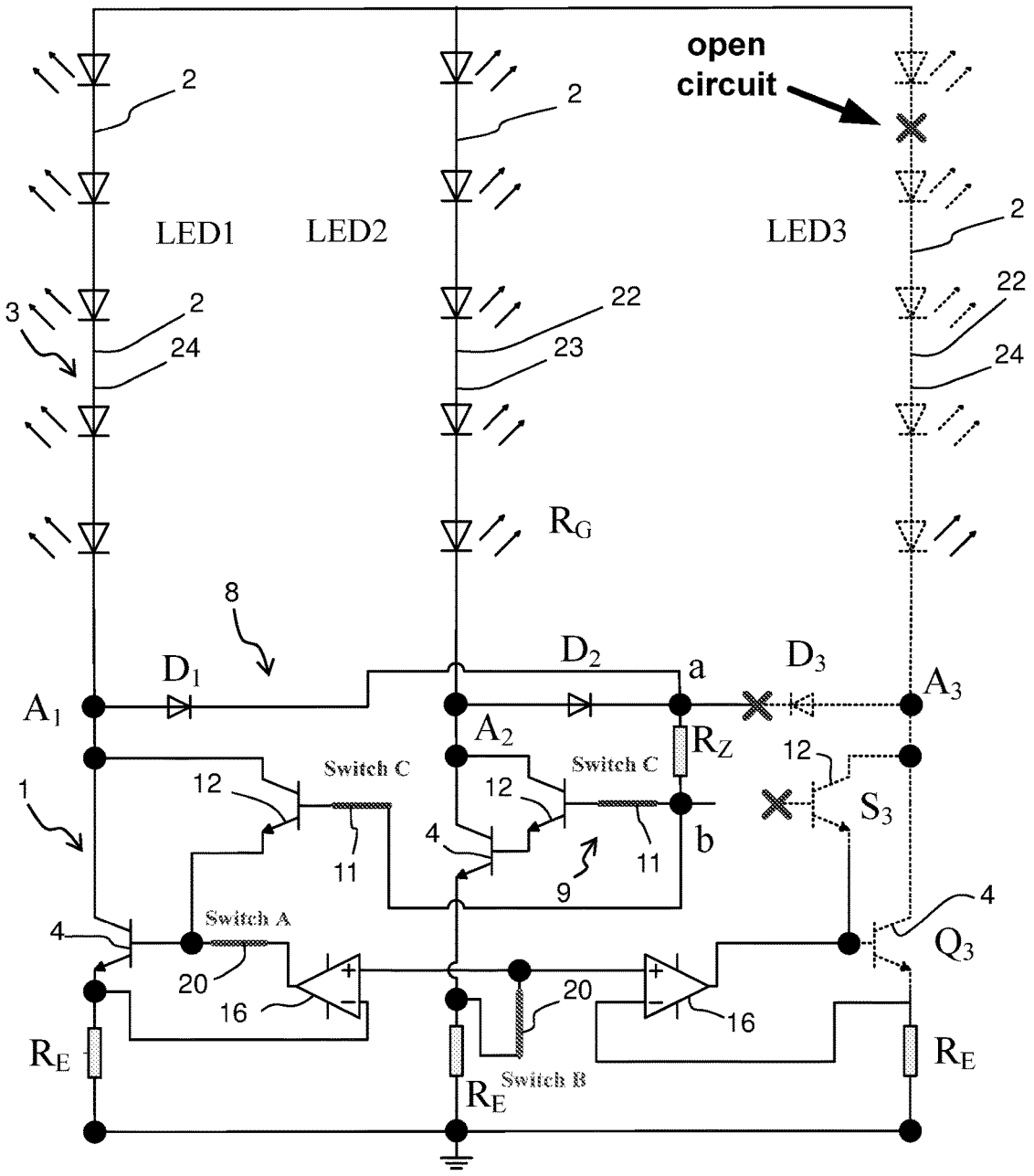
Figure 11A:
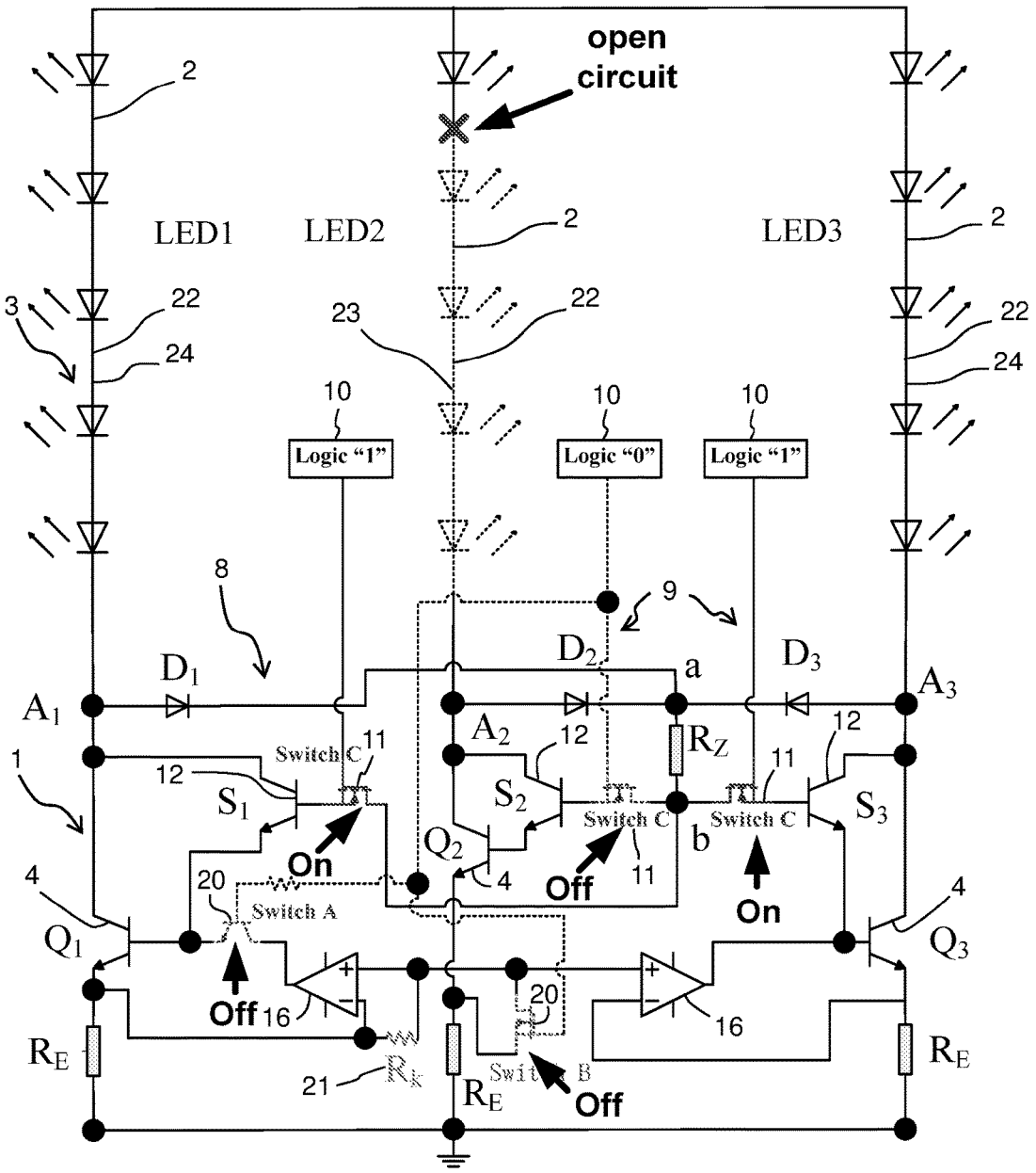
Figure 11B:
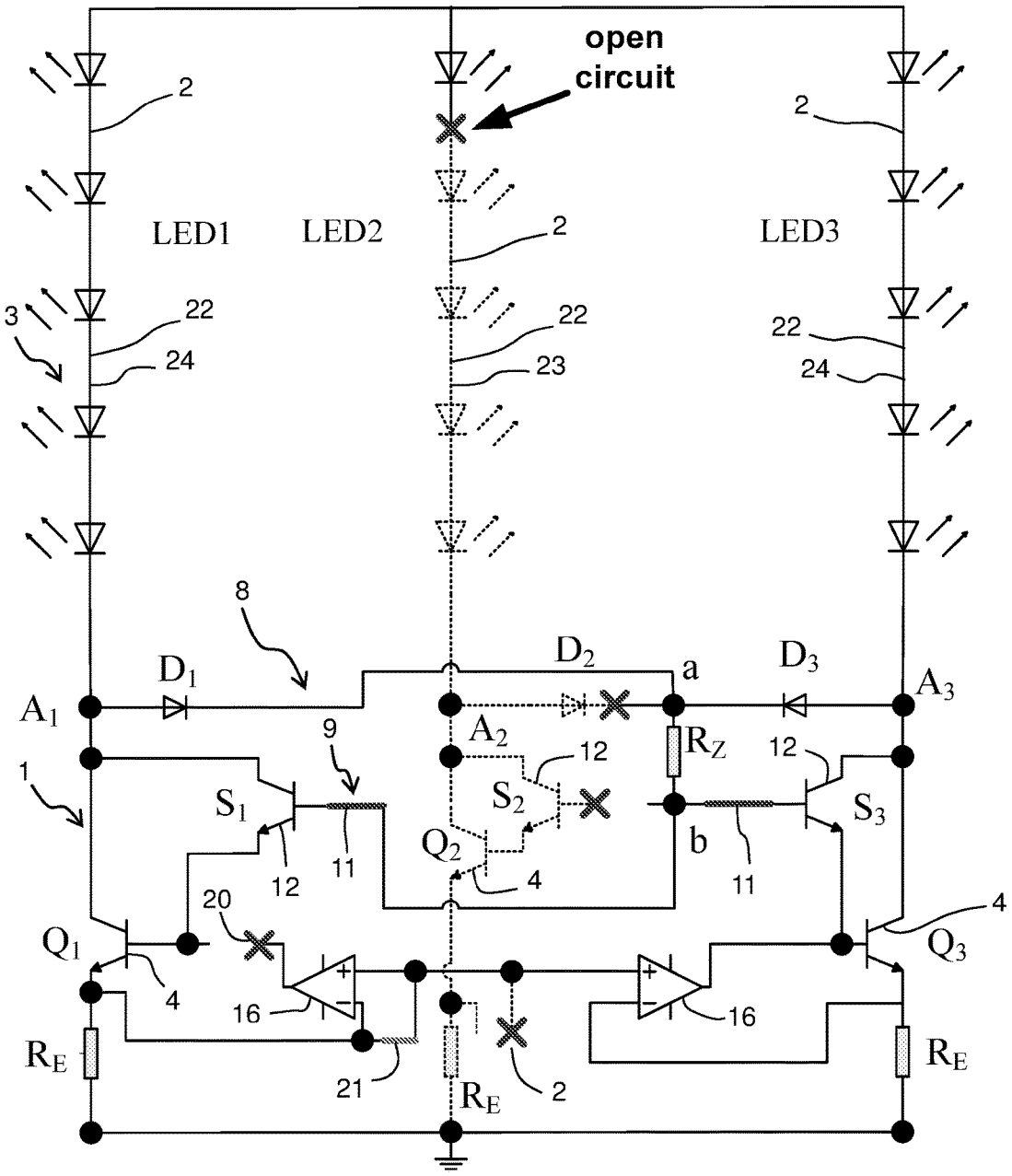
Figure 12:
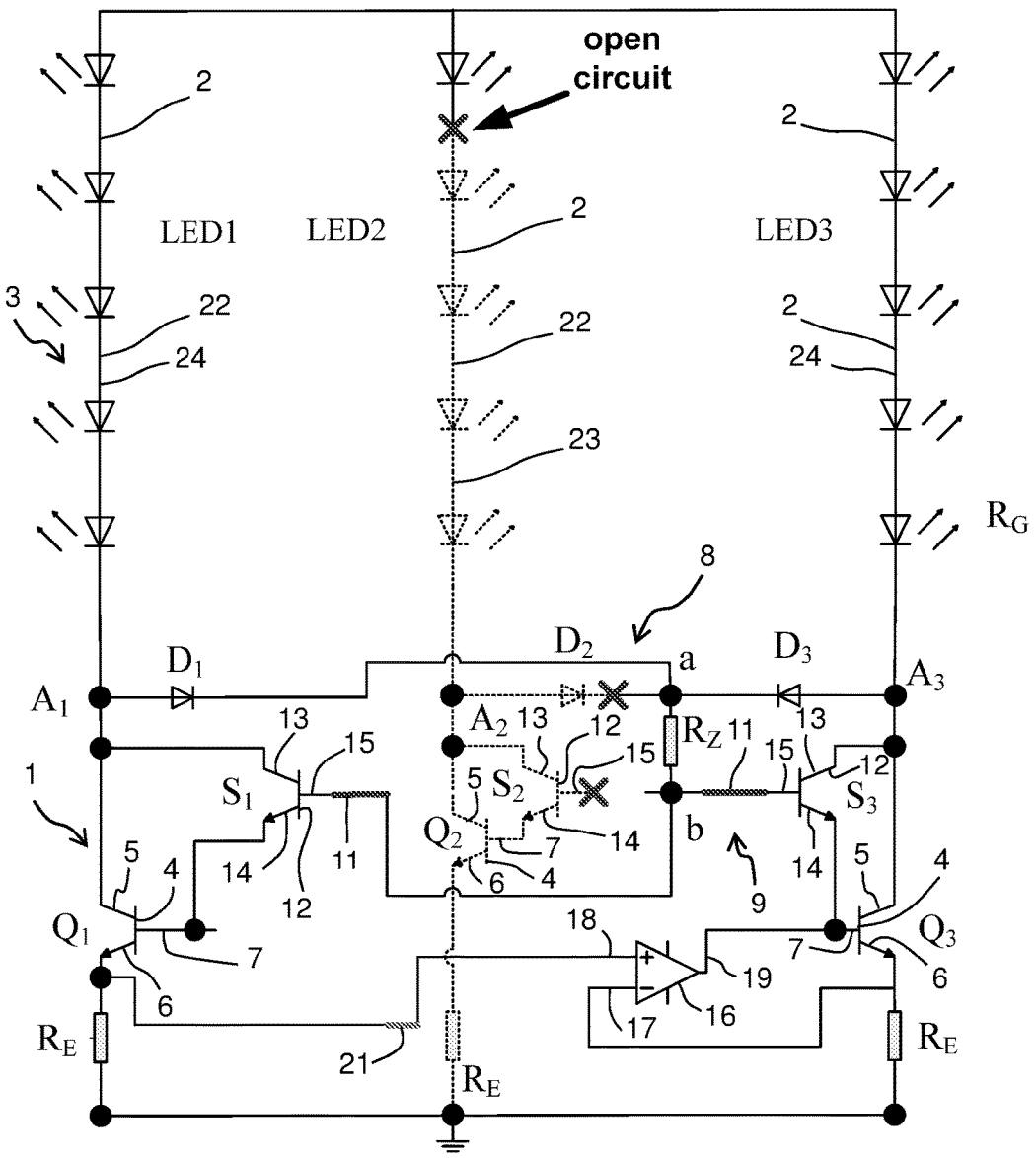
Figure 13A:
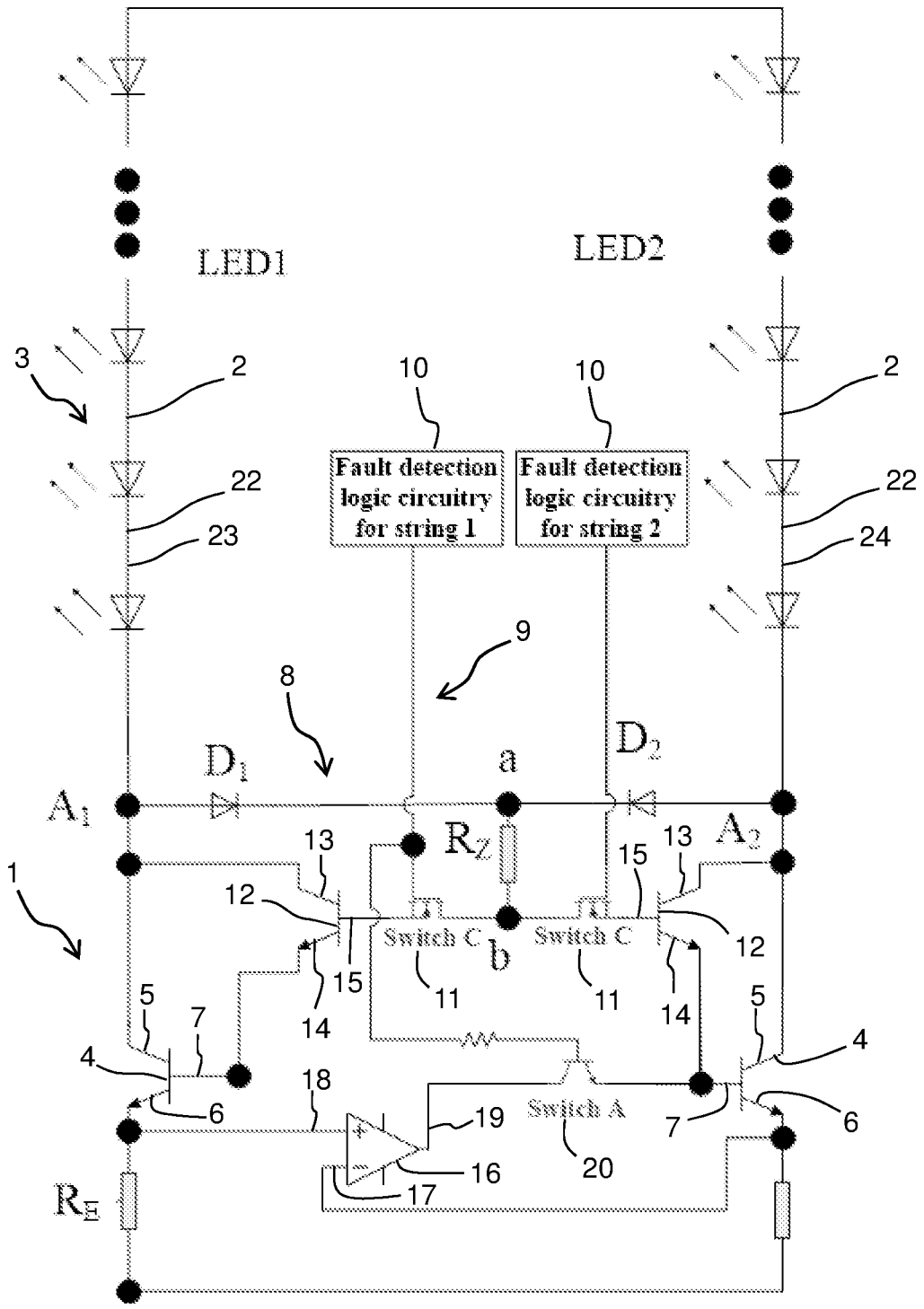
Figure 13B:
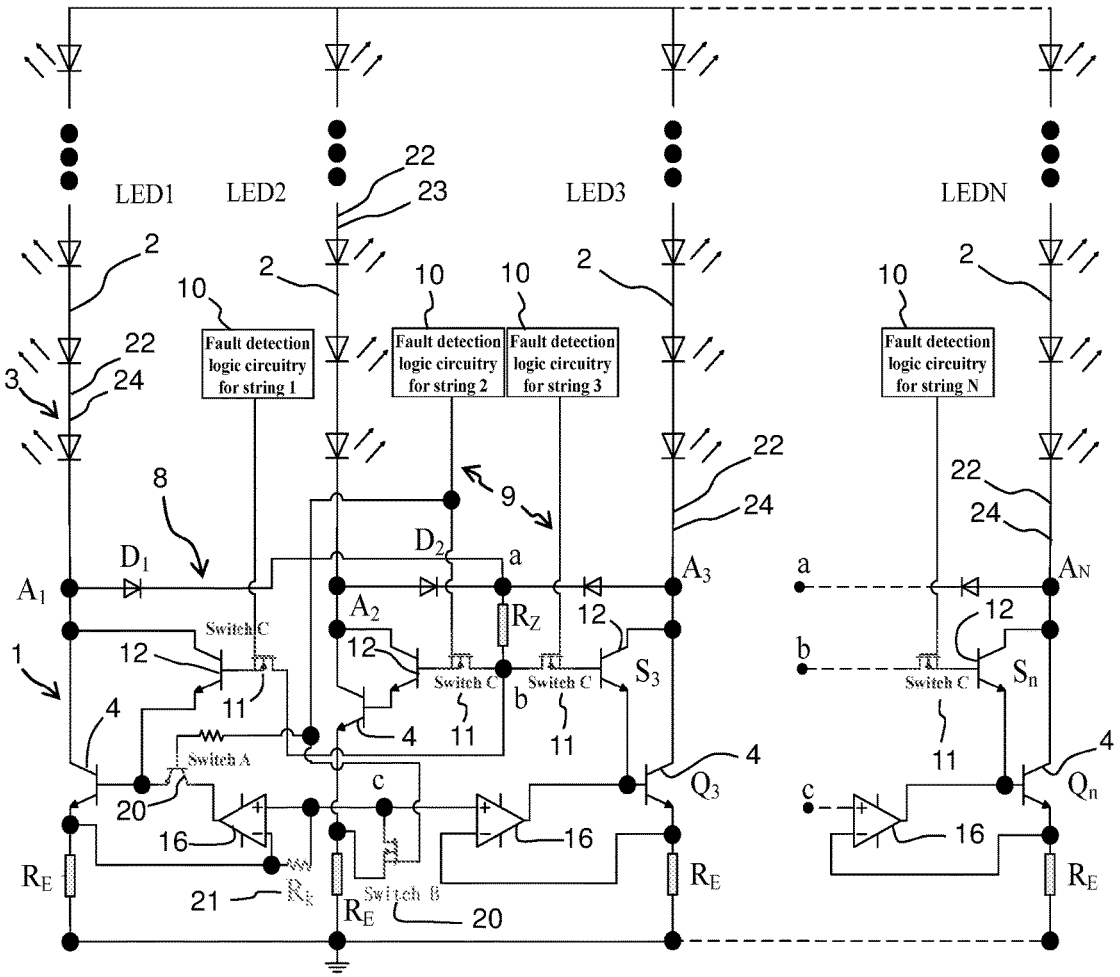
Figure 14:
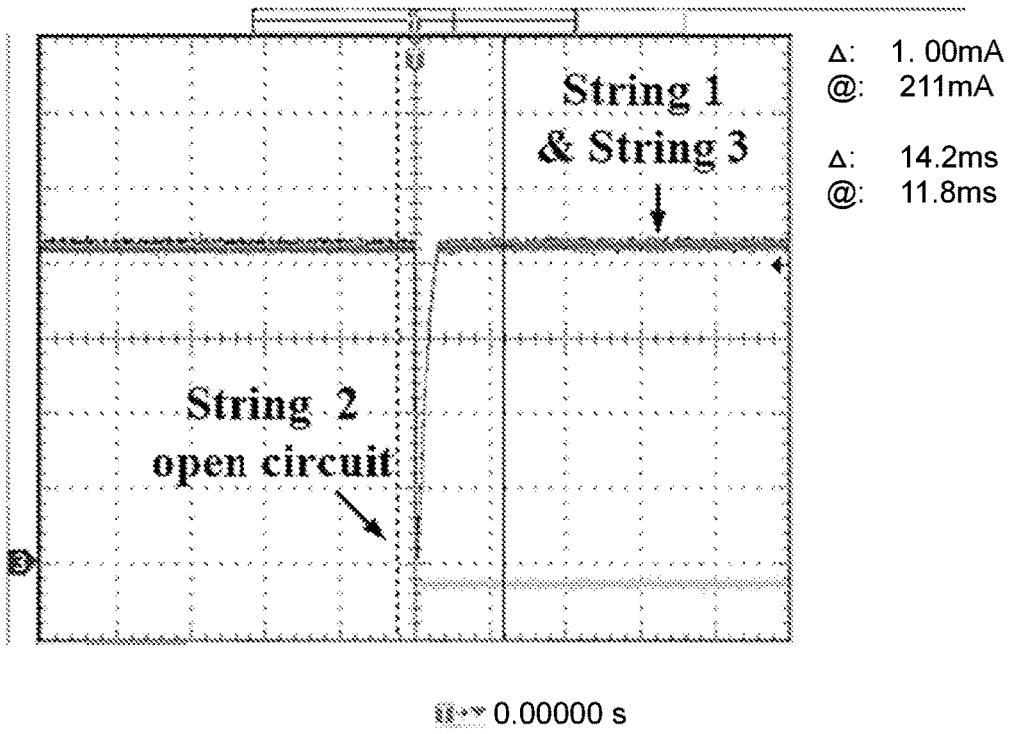
Figure 15:
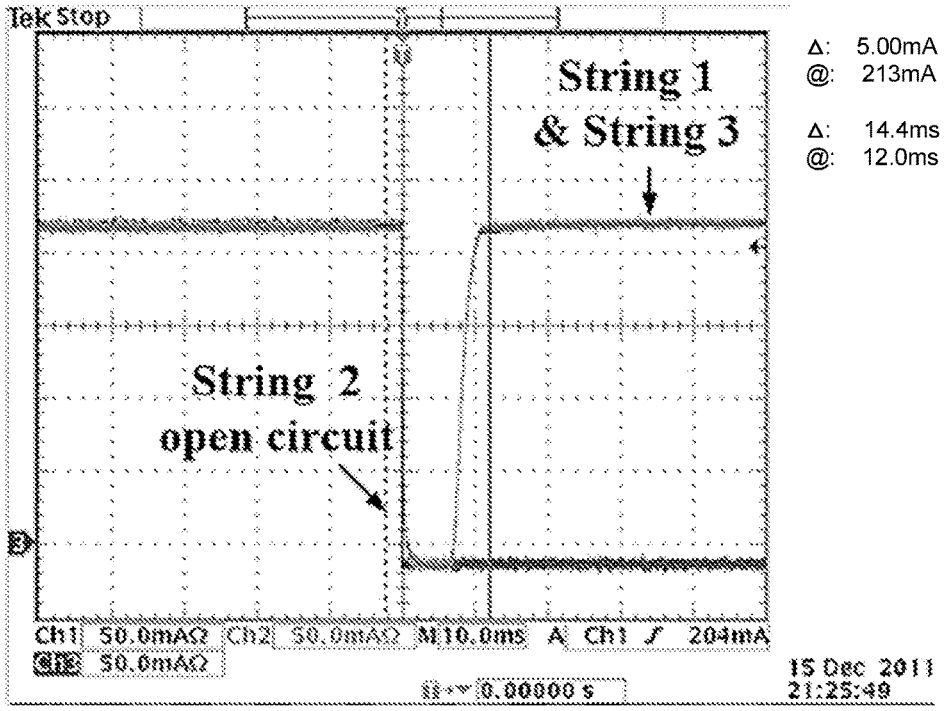

Preferred embodiments in accordance with the best mode of the present invention will now be described, by way of example only, with reference to the accompanying figures, in which:

FIG. 1 is a schematic of a prior art current mirror circuit using self-driven transistors $S_1$ to $S_N$;

FIG. 2 is a schematic of a version of the prior art current mirror circuit of FIG. 1;

FIG. 3 is a schematic of an improved version of the prior art current mirror circuit of FIG. 2 which incorporates an opamp circuit for feedback assistance;

FIG. 4 is a schematic of the prior art current mirror circuit of FIG. 3 showing a simple power supply powering the opamp circuit;

FIGS. 5(*a*) and 5(*b*) are schematics of equivalent circuits to the prior art circuit of FIG. 3 where one of the LED strings has an open circuit fault;

FIGS. 6(*a*), 6(*b*), and 6(*c*) are graphs showing transient current waveforms resulting from an open circuit fault test on a prior art current mirror circuit connected to three LED strings;

FIG. 7 is a schematic of a current mirror circuit in accordance with an embodiment of the present invention as used in a 3-string LED system having two slave LED strings (at the sides) and one master LED string (in the centre);

FIGS. 8(*a*) and 8(*b*) are schematics of fault detection logic circuits in accordance with embodiments of the present invention;

FIG. 9 is a schematic of an equivalent circuit to the circuit of FIG. 7 with feedback isolation switches A and B, and isolation switches C closed (that is, turned on) under normal conditions with no open circuit faults in the LED strings;

FIGS. 10(*a*) and 10(*b*) are schematics of equivalent circuits to the circuit of FIG. 7 where there is an open circuit fault in a slave LED string;

FIGS. 11(*a*) and 11(*b*) are schematics of equivalent circuits to the circuit of FIG. 7 where there is an open circuit fault in the master LED string;

FIG. 12 is a schematic of a simplified equivalent circuit to the circuit of FIG. 7 where there is an open circuit fault in the master LED string;

FIG. 13(*a*) is a schematic of a generalized current mirror circuit for a 2-string LED system in accordance with an embodiment of the present invention;

FIG. 13(*b*) is a schematic of a generalized current mirror circuit for a multi-string LED system in accordance with an embodiment of the present invention;

FIG. 14 is a graph showing measured currents in the LED strings shown in FIG. 7 when the master LED string is isolated; and FIG. 15 is a graph showing measured currents in the LED strings shown in FIG. 7 when a slave LED string is isolated.

BEST MODE FOR CARRYING OUT THE INVENTION

Best Mode

Referring to the figures, an embodiment of the present invention provides a current mirror circuit 1 for balancing respective currents in a plurality of parallel circuit branches 2 in a target circuit 3. The current mirror circuit includes a plurality of balancing transistors 4, each having a collector 5, an emitter 6, and a base 7, the collector 5 and emitter 6 of each balancing transistor connected in series with a respective circuit branch 2. A selection circuit 8 connects the circuit branch 2 having the smallest current amongst the circuit branches 2 to the bases 7 of each balancing transistor 4. An isolation circuit 9 isolates circuit branches 2 having an open circuit fault from the rest of the target circuit 3.

In the present embodiment, the isolation circuit 9 disconnects the circuit branch 2 having the smallest current amongst the circuit branches 2 from the base 7 of the balancing transistors 4 of circuit branches having an open circuit fault, thereby isolating circuit branches 2 having an open circuit fault from the rest of the target circuit 3. The isolation circuit 9 also includes a fault detection logic circuit 10 to detect whether there is an open circuit fault in one or more of the circuit branches 2, thereby allowing the isolation circuit to isolate those said one or more circuit branches having an open circuit fault from the rest of the target circuit 3.

More particularly, in the present embodiment, the isolation circuit 9 includes a plurality of fault detection logic circuits 10, each corresponding to a respective circuit branch 2 to detect whether there is an open circuit fault in said respective circuit branch, thereby allowing the isolation circuit to isolate said respective circuit branch from the rest of the target circuit 3 where said respective circuit branch has an open circuit fault.

The isolation circuit 9 includes a plurality of isolation switches 11, each corresponding to a respective circuit branch 2 and openable to disconnect the circuit branch having the smallest current amongst the circuit branches from the base 7 of the balancing transistor 4 of said respective circuit branch. More particularly, the selection circuit 8 includes a plurality of switching transistors 12, each switching transistor having a collector 13, an emitter 14, and a base 15. The collector 13 of each switching transistor is connected to a respective circuit branch 2, the emitter 14 of each switching transistor is connected to the base 7 of the balancing transistor 4 of said respective circuit branch, and the base 15 of each switching transistor is connected to the isolation switch 11 corresponding to said respective circuit branch.

In the present embodiment, the current mirror circuit 1 includes at least one opamp 16 connected between two of the circuit branches 2 for feedback assistance. The opamp 16 has an inverting input 17 connected to one of said two circuit branches 2, a non-inverting input 18 connected to the other of said two circuit branches 2, and an output 19 connected to the base 7 of the balancing transistor 4 of one of said two circuit branches 2. The isolation circuit 9 includes at least one feedback isolation switch 20 to isolate the circuit branch 2 connected to the non-inverting input 18 from the rest of the target circuit 3 where the circuit branch connected to the non-inverting input has an open circuit fault. The isolation circuit 9 also includes an isolation resistor 21 connected to the non-inverting input 18 such that the non-inverting input is not floating when the at least one feedback isolation switch 20 is opened.

The selection circuit 8 of the present embodiment uses selection diodes $D_1$ to $D_N$ to connect the circuit branch 2 having the smallest current amongst the circuit branches 2 to the bases 7 of each balancing transistor 4. In particular, there is a selection diode for each circuit branch 2, with each selection diode connected from a respective circuit branch 2 and forwardly biased towards a first point "a". Each switching transistor 12 is connected to a second point "b", with the first point "a" and the second point "b" interconnected through a limiting resistor $R_Z$.

With the switching transistors 12, when the current differences among the circuit branches 2 are large, the switching transistors 12 perform like simple switches, as shown in FIG. 1. However, when the differences in currents in the circuit branches 2 are relatively small, the switching transistors operate in a linear range. In this case, the selection diodes will conduct some current, but not the full current and not zero current. Under this condition, the switching transistor 12 and the balancing transistor 4 in each circuit branch 2 will form a Darlington pair transistor, and the current mirror circuit 1 will be equivalent to a basic current mirror circuit. Thus, the switching transistors 12 operate as both simple switches and linear transistors.

It will also be appreciated that in some embodiments simple switches can be used instead of the switching transistors 12, in which case, the current mirror circuit 1 will take the form shown in FIG. 1.

In other embodiments, the selection circuit 8 can take other forms. In one other embodiment, the selection circuit 8 includes a network of selection resistors connected between the circuit branches 2 and the switching transistors 12. The network of selection resistors is configured to selectively close one of the switching transistors 12 to selectively connect the circuit branch 2 having the smallest current amongst the circuit branches 2 to the bases 7 of each balancing transistor 4.

Such selection circuits 8 have been described in WO 2012/095680, which is herein incorporated by reference.

The present invention also provides a method of balancing respective currents in a plurality of parallel circuit branches in a target circuit. An embodiment of the method provided includes: providing a plurality of the balancing transistors 4, each having the collector 5, the emitter 6, and the base 7, the collector 5 and emitter 6 of each balancing transistor connected in series with a respective circuit branch 2; connecting the circuit branch 2 having the smallest current amongst the circuit branches 2 to the bases 7 of each balancing transistor 4; and isolating circuit branches 2 having an open circuit fault from the rest of the target circuit 3.

This embodiment of the method includes disconnecting the circuit branch 2 having the smallest current amongst the circuit branches 2 from the base 7 of the balancing transistors 4 of circuit branches having an open circuit fault, thereby isolating circuit branches having an open circuit fault from the rest of the target circuit 3.

The present embodiment also includes providing at least one opamp 16 connected between two of the circuit branches 2 for feedback assistance, the opamp 16 having an inverting input 17 connected to one of said two circuit branches, a non-inverting input 18 connected to the other of said two circuit branches, and an output 19 connected to the base 7 of the balancing transistor 4 of one of said two circuit branches, with the embodiment further including isolating the circuit branch 2 connected to the non-inverting input 18 from the rest of the target circuit 3 where the circuit branch connected to the non-inverting input has an open circuit fault.

Thus, in order to improve the self-configurable and re-configurable current mirror circuit of the prior art so that it can cope with an open circuit fault without using a separate power supply for a separate predetermined current reference, new measures are introduced in the present invention to isolate the open-circuited current string and the effects of its associated control electronics.

Looking at the figures in further detail, FIG. 7 shows an embodiment of the current mirror circuit according to the present invention applied to a target circuit 3 in the form of an LED system with three parallel circuit branches 2 in the form of LED strings 22. The current mirror circuit 1 of FIG. 7 uses two opamps 16 for feedback assistance.

Before the use of the current mirror circuit 1 of the embodiment shown in FIG. 7 is explained, it should be noted that LED strings 22 can be classified into two groups when opamp circuits are used for feedback assistance, as is the case in the circuit shown in FIG. 7. Referring to FIG. 7, only one of the LED strings 22 provides signals to the non-inverting inputs 18 of the opamp circuits 16. This LED string is labeled as the Master string 23. It should be noted that the Master string 23 is not necessarily the string (i.e. circuit branch 2) chosen as the current reference in the self-reconfigurable and re-configurable current mirror circuit 1.

The remaining LED strings 22 provide their respective signals to the inverting inputs 17 of the opamps 16 and are called Slave strings 24.

However, it should also be noted that even if the Master string 23 has an open circuit fault and has to be isolated, current balancing can still be achieved among the Slave strings 24. The current mirror circuit 1 includes the following:

1. Isolation switches 11 (labeled as "Switch C" in the figures) are used for isolating faulty LED strings 22 from the rest of the target circuit 3. The isolation switches C are turned off (i.e. opened) when an open circuit fault occurs in the LED string 22 to which it is connected.

2. Feedback isolation switches 20 (labeled "Switch A" and "Switch B" in the figures) are used for isolating the LED string 23, and its associated control circuitry, connected to the non-inverting inputs 18 of the opamps 16. It should be noted that the control circuitry of the central LED string 23 in FIG. 7 is also connected to the non-inverting inputs 18 of the two opamps 16. Feedback isolation switch A and feedback isolation switch B are turned off (i.e. opened) when the LED string 23 providing signals to the non-inverting inputs 18 to the opamps 16 has an open circuit fault.

3. Isolation resistor 21 (labeled "$R_k$" in the figures) is included to ensure that the non-inverting inputs 18 of the opamps 16, to which it is connected, are not floating when feedback isolation switch A and feedback isolation switch B are turned off (i.e. opened). Isolation resistor $R_k$ (typically 1 kilo-Ohm) is chosen to be much larger than $R_E$ (typically less than a few Ohm) and much less than the input impedance of the inputs of the opamps 16 (typically higher than the order of Mega-Ohms).

4. Open circuit fault detection logic circuits 10 detect the open circuit faults in their respective LED strings 22. Two versions of these logic circuits are shown in FIG. 8. Under normal operation, the logic circuit 10 corresponding to each LED string 22 provides a logic signal "1" to close isolation switches C for the Slave strings 24, and to close feedback isolation switch A, feedback isolation switch B and isolation switch C for the Master string 23. Otherwise, it will provide a logic signal "0" to turn off (i.e. open) the respective isolation or feedback isolation switch or switches.

The logic circuits 10 highlighted in FIGS. 8(*a*) and 8(*b*) are used to isolate the LED string 22 in which an open circuit fault occurs. The logic circuit 10 provides a logic signal "1" to turn on (i.e. close) the isolation switches C for the Slave strings 24, and feedback isolation switch A, feedback isolation switch B, and isolation switch C for the Master string 23 when the LED strings 22 are under normal operation. Under normal operation, when these switches are turned on (i.e. closed), the equivalent circuit is shown FIG. 9.

Open-Circuit Fault in a Slave String 24:

Now, consider the situation when an open circuit fault occurs in one of the Slave strings 24. Slave strings 24 are those which provide signals to the inverting inputs 17 of the opamps 16. In particular, assume that the Slave string 24 shown on the right-hand side of FIG. 7 has an open circuit fault, as shown in FIG. 10(*a*). The isolation switch C for controlling switching transistor 12 (labeled "$S_3$" in the figures) connected to the Slave string 24 on the right-hand side of FIG. 7 will be turned off (i.e. opened). The voltage at point $A_3$ will drop to a low level such that diode $D_3$ will be reverse-biased and turned off. As a result, the Slave LED string 24 on the right-hand side of FIG. 7 is isolated from the rest of the target circuit 3 as shown in FIG. 10(*b*).

Open-Circuit Fault in the Master String 23:

Master string 23 is the LED string 22 which provides signals to the non-inverting inputs 18 of the opamps 16. In FIG. 7, the central LED string is a Master string 23. Now, assume an open circuit fault occurs in the Master string 23 as shown in FIG. 11(*a*). The logic circuit 10 corresponding to the central Master string 23 will turn off the isolation switch C for the switching transistor 12 (labeled "$S_2$" in the figures) connected to the central Master string 23, feedback isolation switch A and feedback isolation switch B. Since the value of the isolation resistor $R_k$ is much higher than $R_E$ and much lower than the input impedance of the non-inverting inputs 18 of the opamps 16, the isolation resistor $R_k$ effectively ties the non-inverting inputs 18 to one of the inverting inputs 17 of the opamps 16, so that the non-inverting inputs 18 will not be floating. The equivalent circuit when the Master string 23 has an open circuit fault is shown in FIG. 11(*b*). The simplified form of this equivalent circuit is shown in FIG. 12.

The described concept can be extended to a multiple number of parallel current strings 22 (i.e. circuit branches 2) as shown in FIG. 13. If necessary, the bipolar transistors used in FIG. 3 can be replaced by Darlington transistors if it is required to further reduce power loss in the transistors.

Experimental Verification:

The circuit example shown FIG. 7 with three parallel LED strings 22 has been used for practical evaluation. In this example, "String-1" and "String-3" as labeled in the figures are the Slave strings 24 and "String-2" as labeled in the figures is the Master string 23. The first test was to create an open circuit fault by switching off String-2 after the system had been operating under normal conditions, i.e. no open circuit faults. FIG. 14 shows the measurements of the three string currents when String-2 is cut off (i.e. isolated). It can be seen that the three currents are of identical magnitude before the open circuit fault occurs in String-2. It can be seen that, after the open circuit fault has occurred in String-2, the current in String-2 drops to zero, and the currents in String-1 and String-3 are equal.

A second test was also conducted with the one of the Slave strings (String-3) cut off after normal operation. The measured currents of the three strings are recorded in FIG. 15. Again, it can be seen that all three strings share currents well, that is to say, all three string currents are of the same magnitude, before the open circuit fault occurs in String-3. The remaining strings, String-1 and String-2, continue to share currents well after the open circuit fault occurs in String-3.

The present invention advantageously provides current mirror circuits that are self-configurable and re-configurable, and that can continue to operate to balance parallel current sources even if one current source is cut off, such as with an open circuit fault. The present invention provides mechanisms to isolate current sources with open circuit faults. The present invention is well suited to, but is not limited to, reducing current imbalance in parallel light-emitting diode (LED) strings. Particular applications include high-power LED lighting applications such as outdoor and street lighting.

Although the invention has been described with reference to specific examples, it will be appreciated by those skilled in the art that the invention can be embodied in many other forms. It will also be appreciated by those skilled in the art that the features of the various examples described can be combined in other combinations.

The invention claimed is:

1. A current mirror circuit for balancing respective currents in a plurality of parallel circuit branches in a target circuit, the current mirror circuit comprising:

a plurality of balancing transistors, each having a collector, an emitter, and a base, the collector and emitter of each balancing transistor connected in series with a respective circuit branch;

a selection circuit that connects the circuit branch having the smallest current amongst the circuit branches to the bases of each balancing transistor; and an isolation circuit that isolates circuit branches having an open circuit fault from the rest of the target circuit.

2. A current mirror circuit according to claim 1 wherein the isolation circuit disconnects the circuit branch having the smallest current amongst the circuit branches from the base of the balancing transistors of circuit branches having an open circuit fault, thereby isolating circuit branches haying an open circuit fault from the rest of the target circuit.

3. A current mirror circuit according to claim 1 wherein the isolation circuit comprises a fault detection logic circuit to detect whether there is an open circuit fault in one or more of the circuit branches, thereby allowing the isolation circuit to isolate those said one or more circuit branches having an open circuit fault from the rest of the target circuit.

4. A current mirror circuit according to claim 1 wherein the isolation circuit comprises a plurality of fault detection logic circuits, each corresponding to a respective circuit branch to detect Whether there is an open circuit fault in said respective circuit branch, thereby allowing the isolation circuit to isolate said respective circuit branch from the rest of the target circuit where said respective circuit branch has an open circuit fault.

5. A current mirror circuit according to claim 1 wherein the isolation circuit comprises a plurality of isolation switches, each corresponding to a respective circuit branch and openable to disconnect the circuit branch having the smallest current amongst the circuit branches from the base of the balancing transistor of said respective circuit branch.

6. A current mirror circuit according to claim 5 wherein the selection circuit comprises a plurality of switching transistors, each switching transistor having a collector, an emitter, and a base, the collector of each switching transistor connected to a respective circuit branch, the emitter of each switching transistor connected to the base of the balancing transistor of said respective circuit branch, and the base of each switching transistor connected to the isolation switch corresponding to said respective circuit branch.

7. A current mirror circuit according to claim 1 compromising at least one opamp connected between two of the circuit branches for feedback assistance, the opamp having an inverting input connected to one of said two circuit branches, a non-inverting input connected to the other of said two circuit branches, and an output connected to the base of the balancing transistor of one of said two circuit branches, the isolation circuit compromising at least one feedback isolation switch to isolate the circuit branch connected to the non-inverting input from the test of the target circuit where the circuit branch connected to the non-inverting input has an open circuit fault.

8. A current mirror circuit according to claim 7 wherein the isolation circuit compromises an isolation resistor connected to the non-inverting input such that the non-inverting input is not floating when the at least one feedback isolation switch is opened.

9. A method of balancing respective currents in a plurality of parallel circuit branches in a target circuit, the method comprising:

providing a plurality of balancing transistors, each having a collector, an emitter, and a base, the collector and emitter of each balancing transistor connected in series with a respective circuit branch;

connecting the circuit branch having the smallest current amongst the circuit branches to the bases of each balancing transistor; and isolating circuit branches having an open circuit fault from the rest of the target circuit.

10. A method according to claim 9 comprising disconnecting the circuit branch having the smallest current amongst the circuit branches from the base of the balancing transistors of circuit branches having an open circuit fault, thereby isolating circuit branches having an open circuit fault from the rest of the target circuit.

11. A method according to claim 9 comprising providing at least one opamp connected between two of the circuit branches for feedback assistance, the opamp having an inverting input connected to one of said two circuit branches, a non-inverting input connected to the other of said two circuit branches, one on output connected to the base of the balancing transistor of one of said two circuit branches, the method comprising isolating the circuit branch connected to the non-inverting input from the rest of the target circuit where the circuit branch connected to the non-inverting input has an open circuit fault.

* * * * *